US005178887A

United States Patent [19]

O'Conner et al.

[11] Patent Number: 5,178,887

[45] Date of Patent: Jan. 12, 1993

[54] COMPOUND FLUTED MOLD FOR CASTING PRESTRESSED CONCRETE LAMP POLES

[75] Inventors: James F. O'Conner, Grass Valley; William A. Muller, Fillmore, both of Calif.

[73] Assignee: Ameron, Inc., Pasadena, Calif.

[21] Appl. No.: 683,303

[22] Filed: Apr. 10, 1991

[51] Int. Cl.[5] ..... B28B 21/30

[52] U.S. Cl. ..... 425/435; 249/48; 249/154; 249/163; 249/168; 264/311

[58] Field of Search ..... 249/48, 143, 154, 144, 249/163, 164, 168, 169, 51, 49; 425/111, 426, 435; 264/311, 312

[56] References Cited

U.S. PATENT DOCUMENTS

| | | | |
|---|---|---|---|
| 840,637 | 1/1907 | Locher | 249/48 |
| 1,199,095 | 9/1916 | Meister | 249/48 |
| 1,224,584 | 5/1917 | Vogan | 249/48 |
| 1,250,956 | 12/1917 | Bratter | 249/48 |
| 1,299,739 | 4/1919 | Landwehr | 249/48 |
| 1,398,412 | 11/1921 | Barkchat | 249/48 |
| 2,754,563 | 7/1956 | Hartenstein | 425/435 |
| 3,144,699 | 8/1964 | Williams | 249/48 |
| 3,741,707 | 6/1973 | Baumann et al. | 425/435 |
| 3,778,215 | 12/1973 | Starr et al. | 425/435 |
| 4,887,789 | 12/1989 | Harris et al. | 249/48 |

FOREIGN PATENT DOCUMENTS

| | | | |
|---|---|---|---|
| 136377 | 7/1952 | Sweden | 249/49 |

*Primary Examiner*—Jay H. Woo
*Assistant Examiner*—Khanh P. Nguyen
*Attorney, Agent, or Firm*—Christie, Parker & Hale

[57] ABSTRACT

A compound fluted mold segment for casting prestressed concrete lamp poles includes three 120° circumferential sectors wherein each sector contains a mold form made of a thin gauge sheet metal in which are locaed flutes formed by a press-brake operation. A plurality of circumferential flanges are welded on the outside of the sheet meal for stiffening the mold form. Longitudinal gates extend radially outwardly from each edge of the circumferential sectors for connecting the sectors and stiffening the mold segment in a longitudinal direction. Mating annular shoulders are incorporated to maintain concentricity between the fluted mold segment and additional mold segments attached at the ends of the fluted segment.

10 Claims, 2 Drawing Sheets

COMPOUND FLUTED MOLD FOR CASTING PRESTRESSED CONCRETE LAMP POLES

FIELD OF THE INVENTION

This invention relates generally to molds for casting lamp poles and more particularly to a compound fluted mold for casting prestressed concrete lamp poles comprising a plurality of circumferential sections made of relatively thin gauge sheet metal.

BACKGROUND OF THE INVENTION

It is known that the manufacture of prestressed concrete poles involves the casting and hardening of concrete in molds with special requirements for the operations of positioning, stressing and loosening the mold. To date, there have been many commercial articles made from prestressed concrete materials. These articles include tubular pipes, beams, support columns, and poles, which may be reinforced by steel strands in the concrete or by rods, bars, and/or tubes for reinforcement located in the concrete. A large number of prestressed concrete articles have been manufactured and it is always desirable to provide means which makes the manufacturing of these articles less expensive as well as easier to accomplish.

Prestressed concrete lamp poles are cast in a mold. The empty mold is assembled, and in order to prestress a concrete pole, an axial compressive load is placed on the mold. The axial load is transmitted through the mold by prestressing strands which extend through the mold and are attached at either end of the mold. After prestressing, the mold is pumped full of concrete and rotated to centrifugally consolidate the concrete. Once the mold is full, it is generally conveyed through a heated chamber to accelerate the curing of the concrete. The prestressing load is then ready to be transferred from the mold to the pole and the mold can be removed from the finished product.

Typical molds used to cast concrete poles are solid steel molds. Depending upon the intricacy or the ornamentality of the pole to be cast, the mold is composed of separate segments corresponding to each distinct pattern located on the pole. Solid steel molds are composed of two or more pieces in which the pattern to be cast is machined into the interior surface of the mold pieces such that when the pieces are joined together a hollow cavity exists corresponding to the pattern of the pole.

A number of patterns can be incorporated into a single pole, however, it is also common for a single pattern to dominate a pole structure. A very popular pattern for a concrete lamp pole is a fluted pattern. Generally, a fluted pattern dominates the overall pattern of a lamp pole.

There are two problems associated with solid steel molds used to cast a fluted pattern. First, it is very expensive to machine flutes into the mold, and secondly, since a flute pattern can extend many feet along the length of the pole, a solid steel mold is very heavy. Because the mold is so heavy a substantial amount of time and equipment is required to assemble the mold.

Many concrete pole molds are made of segments to be interchangeable so that the designs of the poles can be varied by changing one or more of the segments without having to reconstruct the entire mold. However, since a fluted mold segment is so heavy, changing that segment requires a longer amount of time to accomplish the task.

A third problem associated with segmented solid steel molds is maintaining concentricity when arranging the mold segments. This problem is particularly evident at undercut portions of a pole design. A lack of concentricity can create surface irregularities in a cast pole. To eliminate this problem many pole designs simply forego any undercut portions.

Thus, there exists a long felt need for a new and improved fluted concrete pole mold which is inexpensive to manufacture, lightweight, and provides a means for maintaining concentricity as the mold is assembled, even when the mold contains segments for undercut portions of the pole.

SUMMARY OF THE INVENTION

The present invention provides an inexpensive and lightweight fluted concrete pole mold by substituting relatively thin gauge sheet metal for the conventional solid steel mold. The mold segment is manufactured by forming the flutes in the sheet metal on a press-brake. The fluted segment has been designed to separate into three 120° circumferential sectors. Similarly, the mold can be designed to separate into four 90° circumferential sectors or three sectors with unequal circumferential measurements depending on the particular application. The sectors are connected by gates extending outwardly perpendicular to each edge of the 120° sector. The gates extend the entire length of the 120° sectors and contain a plurality of holes passing therethrough so that the gates can be bolted together.

The fluted segment is stiffened with a plurality of uniformly spaced circumferential flanges. The flanges extend outwardly from the outer surface of the sheet metal and perpendicular to the gates. The sheet metal may be further stiffened by a longitudinal rib located on each 120° sector and parallel to the gates which is secured to the outer edge of the flanges opposite the sheet metal.

The pole mold separates circumferentially along the 120° sectors and longitudinally depending upon the decorative design of the pole. The more intricate the design, the more points of separation. Each different design feature employs a separate mold segment. Circumferential flanged joints have been located between each different mold segment to connect each segment and also enable the removal of individual mold segments to allow for interchanging various decorative designs in the same general mold.

To maintain concentricity, when additional segments are bolted to the fluted segment, the circumferential flanges have been designed with special annular shoulders such that when mated they maintain mold alignment. Additionally to ensure proper alignment of the 120° circumferential sectors, the mold gates have regularly spaced tapered cone nuts. The present mold design, as well as maintaining concentricity, allows for the casting of very ornamental pole designs which include extensions and depressions from the concrete pole surface.

The resulting mold, is less expensive to manufacture because it requires less material and eliminates costly machining processes. Besides being less expensive, the mold is lightweight which makes it easier to assemble and disassemble. Additionally, because the mold segments are interchangeable, the process of substituting segments can be accomplished in a substantially smaller amount of time.

These and other aspects of the invention will be more fully understood by referring to the detailed description and the accompanying drawings.

DETAILED DESCRIPTION

Figure 1:
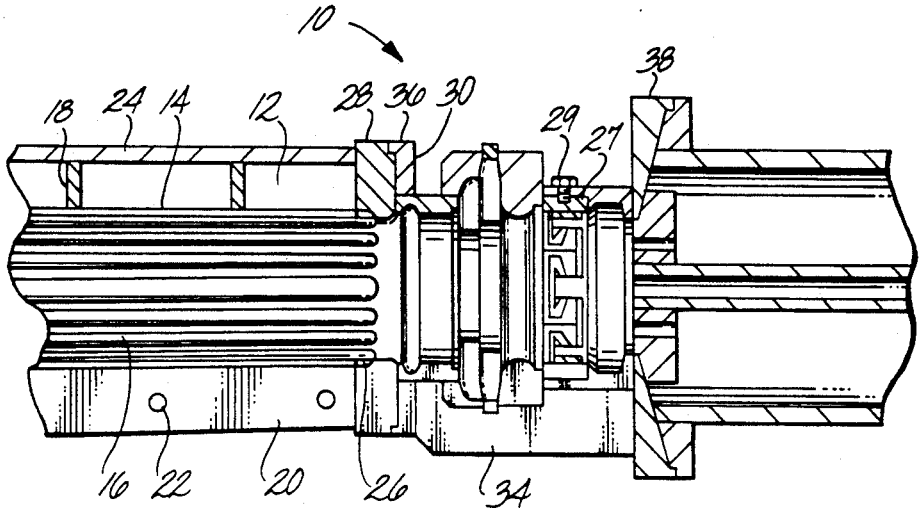
FIG. 1 is a longitudinal cross-sectional view of the top portion of a fluted concrete pole mold.
Figure 2:
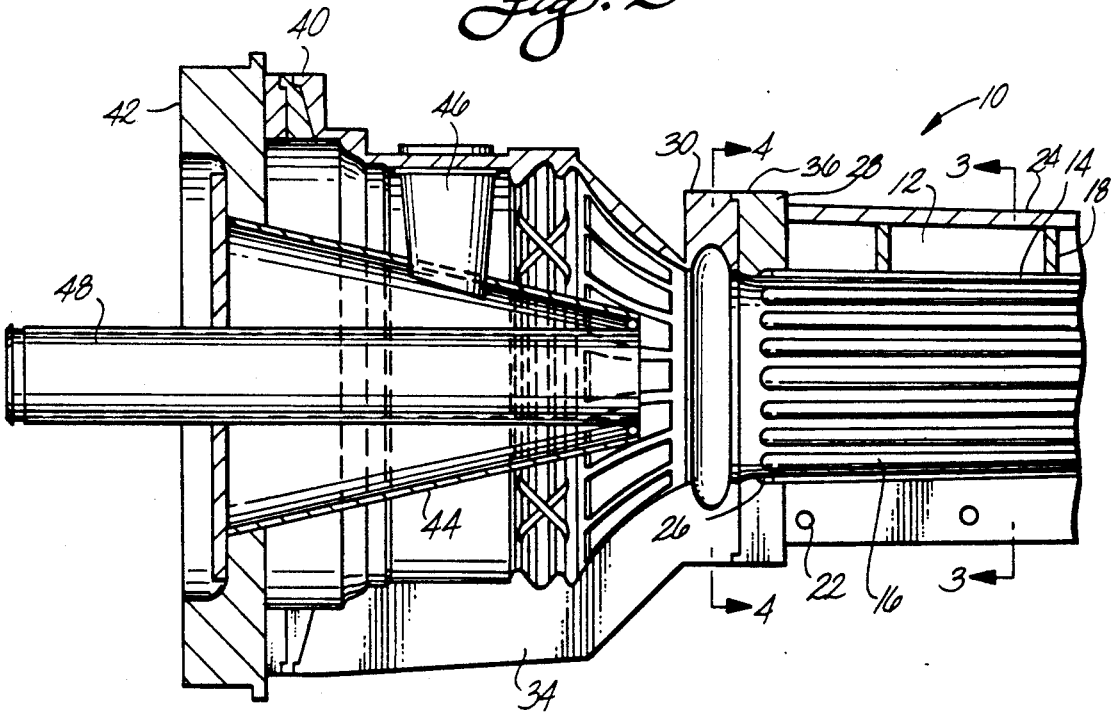
FIG. 2 is a longitudinal cross-sectional view of the base portion of the mold of FIG. 1.

FIGS. 1 and 2 illustrate the top and base portion of a fluted concrete pole mold constructed in accordance with principles of this invention. The mold 10 is comprised of segments, a separate segment being used for each different decorative configuration incorporated into the concrete pole. A central mold segment 12 provides for the casting of a fluted design extending a major portion of the pole length. This central segment includes a mold form 14 which is made from a relatively thin gauge sheet metal, preferably 14 gauge steel, into which the flutes 16 are formed on a press-brake. The flutes are bent into the sheet metal such that both the bottom and the top surface of the sheet metal are bent during the press-brake operation, resulting in a flute formed by the full thickness of the metal. The mold form is stiffened with circumferential flanges 18 tack welded to the sheet metal and extending outwardly from the mold form. The circumferential flanges are evenly spaced along the longitudinal length of the mold segment. A typical pole tapers from a wider base toward a narrower top. The inside radius of the flanges gets gradually longer along the length to accommodate the taper in the mold.

Figure 3:
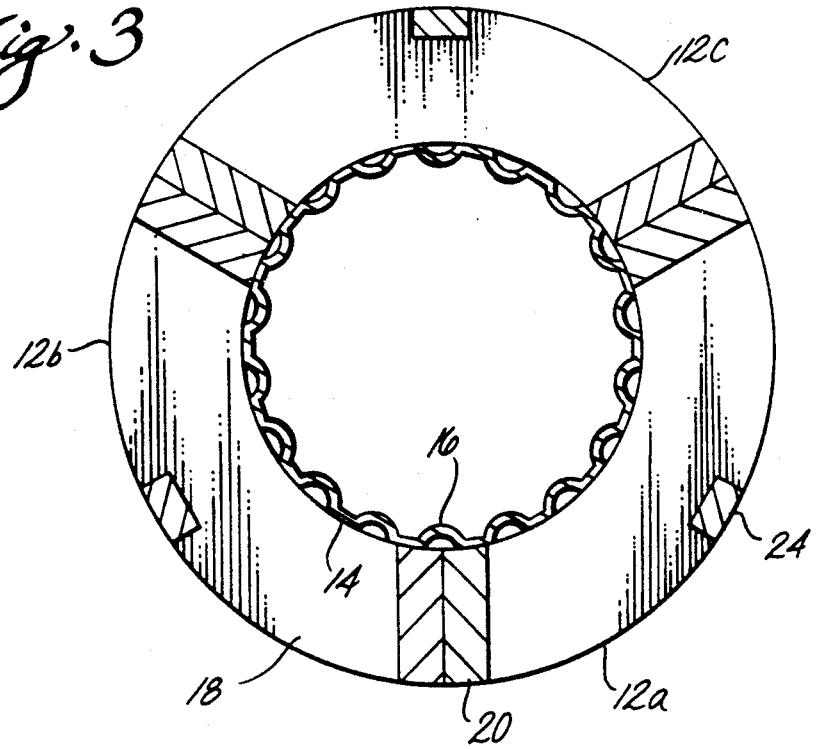
FIG. 3 is a transverse cross-sectional view taken along the line 3—3 of FIG. 2.

As can be seen in FIG. 3, the mold segment has been designed to separate into three 120° circumferential sectors 12*a*, 12*b*, and 12*c*, bolted together by gates 20 located at each edge of each 120° sector. The mold gates extend outwardly from the mold surface and are perpendicular to the flanges. The gates have a series of holes 22 equally spaced along the length of the gate to accommodate their being bolted together. When the sectors are bolted together they construct the periphery of a cavity in which the pole may be cast.

The mold segment is given further support by a stiffening rib 24 running the longitudinal length of the segment and located along the outer surface of the circumferential flanges. An identical stiffening rib is located on each 120° sector. The flanges, ribs, and gates stiffen the sheet metal portions and provide means for bolting the portions together.

The three 120° mold sectors are bolted together along the length of adjacent gates. Regularly spaced bolt holes 22 along the length are tapered for receiving conventional cone nuts to ensure proper alignment of the mold sectors.

The fluted sheet metal portion of the mold sector is made by bending in a press-brake with the flutes extending the full length of the sector.

The cup end of the flutes are formed in the concrete pole by welding a bull nose 26 onto the end of the mold surface at each end of the flute. The bull nose is created by simply turning a rounded end on a piece of bar stock, cutting off the rounding end and cutting the proper size off of the rounded end. A separate bull nose is welded at each flute at each end of the flute mold segment. Since the fluted segment is slightly tapered towards the top end of the pole, the bull noses welded to the top end of the mold segment are slightly smaller than those used at the base end.

The mold of the present invention allows for the casting of very ornate concrete poles, both with radially extending extensions and depressions from the general surface of the pole. Because of the ornate features of a concrete pole, a separate mold segment is used for each different design. The more intricate the decorations incorporated into the pole the more points of mold separation. The top end of the mold and the base end of the mold in FIGS. 1 and 2 are very ornate and a separate mold segment 's used for each different extension or depression in the pole design. These mold segments are standard solid steel molds machined to the required dimensions.

Extremely ornate patterns are easily cast into the pole by the use of a pattern block 27. The block contains the pattern and is located underneath a mold sector and attached to the sector by a bolt 29. A number of blocks can be located underneath a mold sector. To change the pattern the bolt is removed and the sector is stripped which allows the blocks to be lifted out. Different patterned blocks can then be substituted and have been designed to be interchangeable.

Figure 4:
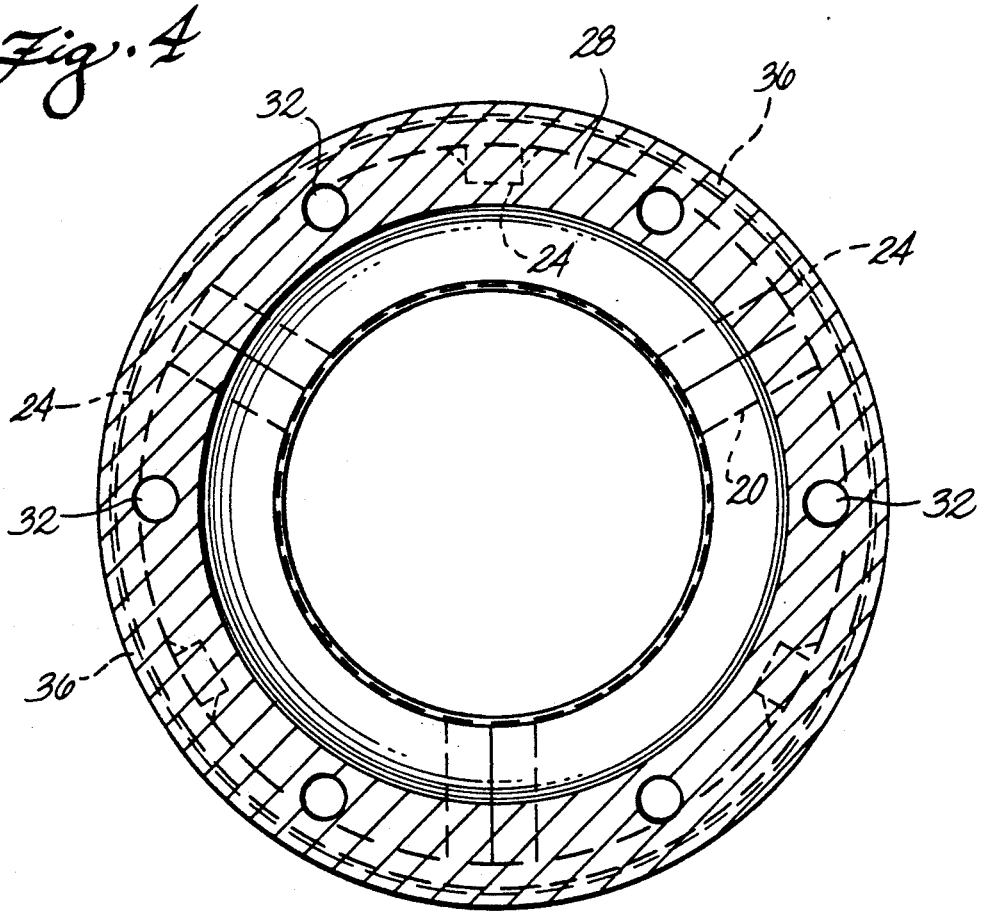
FIG. 4 is a transverse cross-sectional view taken along the line 4—4 of FIG. 2.

The top and base mold segments are bolted to the fluted segment by circumferential flanges 28 and 30. These flanges, as can be seen in FIG. 4, have holes 32 passing therethrough to accommodate the bolts. These circumferential flanges enable the removal of individual mold segments from the pole when it has been cast, as well as enabling interchange various decorative designs within the same general molds.

The solid steel molds at the top and base end of the concrete pole, likewise, are circumferentially divided into 120° sectors. As with the fluted segment, a longitudinal gate 34 is tack welded on each edge of the 120° sector to bolt the sectors together.

Because there are a number of mold segments to accommodate the extensions and depressions in a pole of ornamental design, a problem arises with maintaining concentricity of the numerous mold segments. To alleviate this problem, the circumferential flanges 28 and 30 at each end of the center segment of the mold each have an annular shoulder 36 to maintain concentricity when the mold segments are assembled. Similarly, mating annular shoulders 38 and 40 located in the top and bottom end segments of the mold, respectively, are incorporated for maintaining proper alignment. This feature for maintaining concentricity is not only important in initial assembling of the mold but also when various mold segments are interchanged in the same general mold. The location of the shoulders are designed to allow for disassembly of the mold.

At the bottom end of the mold there is an end closure plate 42 bolted to the bottom of the mold sectors defining the base of the pole. A conical insert 44 on the end closure plate defines a hollow interior for the base of the pole. A plug 46 in one of the 120° sectors of the base mold extends to the conical insert to provide an access opening for a junction box for the electrical wiring. A tube 48 for pumping the concrete into the mold passes through the conical insert and extends beyond its base end.

The mold of the present invention is significantly less expensive to manufacture since the fluted mold segment is manufactured by bending sheet steel rather than machining a traditional solid steel mold. Cost is reduced not only from the fact that there is less material cost but the expensive operation for machining the flutes has been eliminated. Not only is the fluted segment less expensive but is now lightweight. The mold segment can be easily maneuvered in assembling the overall mold, and also lowers the time required to remove the mold when the concrete pole has been cast or when interchanging that segment.

Although the present invention has been described and is illustrated with respect to a preferred embodiment thereof, it is to be understood that it is not to be so limited, since changes and modifications may be made therein which are within the full intended scope of this invention as hereinafter claimed.

What is claimed is:

1. A sector of a mold for centrifugally casting fluted prestressed concrete poles comprising:

an elongated sheet metal form formed into an arch extending a fraction of the circumference of a generally circular cross section and having a plurality of longitudinally extending flutes formed in the concave face of the sheet metal deeply enough to also deform the convex face of the sheet metal;

means on the convex face of the sheet metal for stiffening the form in a circumferential direction;

means on the convex face of the sheet metal for stiffening the form in a longitudinal direction; and means for connecting the form to adjacent forms for forming the periphery of a cavity in which a pole is centrifugally cast.

2. A sector as recited in claim 1 wherein there are three circumferential sectors each extending 120° around a transverse cross section of the mold for collectively defining a cavity in which a pole is cast.

3. A sector as recited in claim 1 wherein the means for stiffening the form in circumferential direction comprise a plurality of circumferential annular flanges connected to the convex face of the sheet metal.

4. A sector as recited in claim 3 wherein the means for stiffening the form in a longitudinal direction comprises a longitudinal stiffening rib extending perpendicularly to the flanges and connected to the flanges.

5. A sector as recited in claim 1 wherein the means for connecting the form to adjacent forms comprises longitudinal gates located at each edge of each form which allow the forms to be bolted together.

6. A sector as recited in claim 3 comprising a circumferentially extending shoulder adjacent an end flange for maintaining concentricity of the sector with another mold sector adjacent to the first mentioned sector.

7. A mold for centrifugally casting fluted prestressed concrete poles comprising:

a plurality of elongated sheet metal forms, each form extending 120° around the circumference of a cavity in which a pole is centrifugally cast and having longitudinally extending flutes formed in both the concave and convex surface of the sheet;

a plurality of annular flanges extending 120° around an outside of each form and tack welded to the surface of the form for stiffening the form in a circumferential direction;

a longitudinally extending gate welded along each side edge of each form for stiffening each form in a longitudinal direction; and means for connecting adjacent gates on adjacent forms together for assembling three forms for defining a mold cavity.

8. A mold as recited in claim 7 further comprising a stiffening rib extending along the form between the gates and secured to the flanges for further stiffening the form.

9. A mold as recited in claim 7 wherein the annular flanges have a circular inside surface and are welded to the sheet metal form at a maximum radius portion on the outside surface of the sheet metal form.

10. A mold as recited in claim 7 comprising a circumferentially extending shoulder adjacent an end flange for maintaining concentricity of the cavity with an adjacent mold segment.

* * * * *